United States Patent [19]

Welch

[11] 3,964,614

[45] June 22, 1976

[54] LIFTING ATTACHMENT FOR A CRANE

[76] Inventor: Forrest D. Welch, 1715 Stone St., Saginaw, Mich. 48602

[22] Filed: Nov. 14, 1974

[21] Appl. No.: 523,703

Related U.S. Application Data

[60] Division of Ser. No. 251,926, May 10, 1972, Pat. No. 3,907,142, which is a continuation-in-part of Ser. No. 175,170, Aug. 26, 1971, Pat. No. 3,760,963.

[52] U.S. Cl. ..... 212/9

[51] Int. Cl.[2] ..... B66F 9/06

[58] Field of Search ..... 214/145, 761, 620, 763, 214/780, 764, 671, 672; 212/8 R, 9, 61–65, 44

[56] References Cited

UNITED STATES PATENTS

| | | | |
|---|---|---|---|
| 1,384,768 | 7/1921 | Luce | 214/DIG. 10 |
| 2,646,182 | 7/1953 | Maas | 214/660 |

*Primary Examiner*—Albert J. Makay
*Assistant Examiner*—Lawrence J. Oresky
*Attorney, Agent, or Firm*—Lane, Aitken, Dunner & Ziems

[57] ABSTRACT

A portable, readily attachable and detachable, mobile materials handling device which is capable of being selectively connected at or near the extreme end of the boom of a crane, for example, a hydraulic crane, to provide the crane with a fork lifting capability. When suspended from the boom head of a crane, the device is free from engagement with any support member of the crane other than the boom head. The attachment comprises elevator means which include a fork lift carriage assembly capable of being raised and lowered in cooperation with a plurality of telescoping channel members by the operation of the load line of the crane to achieve the desired lifting functions at all positions accessible by the boom of the crane. Leveling means are provided for maintaining the orientation of the fork lift, for example, in a substantially horizontal position, wherein the main frame of the elevator mechanism is maintained in a substantially vertical position. The leveling means comprise a pair of spaced leveling members defining gear racks which mate with similar drive pinions driven by a power source connected to the power system of the crane. The leveling members are secured to the elevator means so that, by operation of the drive pinions, the lower end of the elevator means may be advanced or retracted relative to the vertical by the tracking of the leveling members. The apparatus is arranged for convenient and rapid attachment to the crane, and the method of attachment is disclosed wherein the load line of the crane is reeved about a plurality of guide members, to connect to the boom of the crane. When so positioned, the device is raised into a connecting alignment with attaching pins on the boom head to be automatically secured thereabout with a locking member. The primary latching mechanism comprises the attaching pins on the boom of the crane which cooperate with cammed, generally U-shaped slots on plates secured to the device and further includes the locking members for enveloping the attaching pins and being secured thereabout by a dog member. A secondary safety locking mechanism is disclosed comprising laterally actuatable pins in the plates on the device to be secured in mating recesses in the boom head by the operation of the secondary pin latching mechanism. The apparatus is characterized as being readily attached and detached from the boom of the crane and as being operable throughout the range of operation of the boom, for example, 0 to 70 degrees or more relative to a hoxizontal plane. Moreover, the load space above the fork lift is substantially free from interfering members to accommodate a wide variety of loads.

In another embodiment, the leveling means comprises one or more hydraulically actuated members, for example, hydraulic cylinders, connected either directly or through linking means to the elevator means for orienting the fork lift carriage assembly.

2 Claims, 23 Drawing Figures

LIFTING ATTACHMENT FOR A CRANE

CROSS REFERENCE TO RELATED APPLICATIONS

This is a division, of application Ser. No. 251,926 filed May 10, 1972 now U.S. Pat. No. 3,907,142 issued 9/23/75, which is a continuation-in-part of Ser. No. 175,170 filed Aug. 26, 1971, now U.S. Pat. No. 3,760,963 issued 9/25/75.

BACKGROUND OF THE INVENTION

This invention relates to an apparatus which provides a fork lift material handling capability to a crane. More particularly, this invention relates to a portable, mobile, readily attachable and detachable fork lift attachment for a crane, preferably a hydraulic crane. Still more particularly, this invention relates to a fork lift attachment for a crane which includes means for maintaining the fork lift in a predetermined orientation throughout the entire range of operation of the crane.

The art of material handling has produced a number of material handling devices both for general application, such as a wide variety of types of cranes and ground-based fork lift devices, as well as devices for specialized applications. Such cranes, including hydraulic cranes, have been quite useful in a number of operations for transferring loads from a first location to a second location, particularly where the locations are at substantially different heights. Another of the advantages of cranes is that a crane may be effectively used in an area spaced above the load to be transported so that the floor space, for example, in a warehouse or in a storage area, can be more efficiently utilized.

Another advantage of such cranes in material handling is that the boom on the crane may be telescoped to lift loads from areas near the cab of the crane as well as areas remotely related to the cab. However, cranes have a disadvantage in material handling in that the goods to be removed from storage or placed in storage by the crane generally must be banded together or otherwise wrapped and enveloped with cable or strapping to be secured to the hook of the crane. Such operations are generally time consuming and in the interest of greater efficiency, it would be desirable to be able to transport loads with a crane while avoiding the necessity of banding or cabling the load.

On the other hand, the art has produced a number of land based vehicles which include a fork lift or platform assembly for lifting loads from the ground level to some minimal height relative to the ground, such as on the order of ten to twelve feet. Such fork lift trucks have substantial advantages in rapidly handling loads at the ground level, particularly loads which are palletized. However, a disadvantage of fork lift trucks is that the accessibility of the load is limited to spaces in which the vehicle can maneuver and such devices are not necessarily the most efficient for transporting goods over long distances because of the transit time of the vehicle.

Thus, it is an aim in the art to provide a fork lift attachment for a crane, particularly a hydraulic crane, to provide the same material handling capabilities as a fork lift or stacker truck while retaining the versatility of the crane.

One such device has been disclosed in the patent to Hallsworth, U.S. Pat. No. 3,033,401, issued May 8, 1962 In the device there disclosed, a substantially vertical mast is attached to the boom of a crane member at a point somewhat remote from the end of the boom and a lower point on the mast is secured to a second point on the crane for stability. Such a connection restricts the range of operation of the device. Because of the particular arrangement, the lifting hook for raising the fork lift assembly is disposed above the tines of the fork and thus limits the height of the materials which may be handled. Accordingly, it is an aim in this art to provide a fork lift attachment for use with a crane, which is secured to the crane only at the point of attachment so that the entire arcuate range of the boom of the crane may be used. It is an additional aim in the art in connection with such devices to maintain, insofar as possible, the area above the tines of the fork lift device free from interference to accommodate relatively high loads.

A similar fork lift attachment is disclosed in the U.S. Pat. to McCune, No. 2,941,685, issued June 21, 1960.

Other devices are known to the art which use portable mast assemblies which are intended to be used on a ground surface and in which the lifting member is controlled by the load line of a crane. However, such devices have a distinct lack of the versatility of the portable fork lift attachment of this invention which may be utilized on the extreme end of the boom of a crane and in positions which are free from ground support or other stabilizing connection to the crane.

It has been a substantial problem in the implementation of a device designed to achieve the aims set forth above to provide a mechanism for maintaining the load in a level position or in any other desired orientation, throughout the range of the boom relative to the horizontal, for example, from 0° to 70°, or even more. Accordingly, it is a constraint on the development of such devices in order to utilize fully the capabilities of the crane to provide means for leveling the load over the entire range of the crane. For example, the Hallsworth device discloses the use of a limited leveling capability, but such leveling is not available for a very wide range of use for the crane. Still further, it would be desirable in the development of such devices to minimize the number of connections to the crane and the points of attachment. Accordingly, it is an aim of this invention to provide a fork lift attachment for a crane which may be secured near the end of a boom and be utilized free from additional connections to the crane and from ground support so as to be a portable, mobile device and to provide means for leveling the load over the entire range of operation of the boom of the crane.

It is an additional object of this invention to provide a fork lift attachment for a crane in which the elevator lift mechanism is operable utilizing the load line of the crane.

It is an additional object of this invention to provide a portable fork lift attachment for use with the crane which is readily connected and disconnected from the crane so that the crane may be used for other purposes when the fork lift capability is not needed.

It is a further object to this invention to provide a fork lift attachment for a crane which minimizes the mechanical, electrical or hydraulic connections necessary to accommodate the device to the crane.

It is an additional object of this invention to provide means for leveling the load throughout the range of throw of the boom of the crane, and to provide such a leveling capability which may be automatically controlled.

It is an additional object of this invention to provide a device of the type described which may be stored on the ground or other convenient surface and readably attached and detached from the crane.

These and other objects of the invention will become more apparent from the following written description of the invention taken in conjunction with the accompanying drawings.

BRIEF SUMMARY OF THE INVENTION

Directed to achieving the aims and objects set forth above, the apparatus according to the invention comprises a portable, mobile, readily attachable and detachable, fork lift attachment for use in connection with a crane, for example, a hydraulic crane. The apparatus comprises elevator means which include a plurality of fork members which may be raised or lowered by the load lines of the crane to lift or lower loads disposed upon the fork members. The elevator means comprises a pair of main frame members, each of which is in a telescoping relationship with a second pair of frame members to extend the vertical height capabilities of the device. A latching arrangement is included as a part of the elevator mechanism to latch and store the inner telescoping members when the fork members are intermediate the length of the main frame members. The latching arrangement is actuated by the descent of the fork lift carriage assembly to release a latch from a latching member and relatively immediately transfer it to a trip lug so that the inner telescoping members and the fork lift carriage assembly may be lowered to a level beneath the extent of the main frame members.

Leveling means are provided for leveling the load. The leveling means comprise a pair of spaced leveling members, each having one end thereof connected to the elevator means. The leveling mechanism includes a rack and pinion assembly wherein the drive pinions are driven by a motor through a worm gear arrangement to cause a pair of leveling rack members respectively located on the leveling members to advance or retreat relative to the drive pinions thus to adjust the orientation of the elevator means. In this manner, the elevator frame members may be maintained in a relatively vertical position, or in any other desired orientation to maintain the load on the forks in a level, or substantially horizontal, position.

Securing means are provided for securing the device to the head of the boom of the crane. The securing means include a pair of plates defining generally U-shaped recesses to receive a pair of attaching members on the head of the crane. Secondary securing pins which are operable with a push rod arrangement are received in corresponding recesses in the head of the crane. Additional features of the invention whereby the apparatus may be readily connected and disconnected from the crane, and automatic leveling means for automatically maintaining the elevator frame members in a relatively vertical position are disclosed in greater detail.

In another embodiment, the leveling means include one or more hydraulically actuated members, for example, hydraulic cylinders, connected either directly or through linking means to the elevator means for orienting the fork lift carriage assembly. The linking means includes an idler member connected to the hydraulically extensible member of the cylinder and to the leveling member which remains relatively fixed. A linking member is also secured at one end to the connection of the extensible member and to the idler member and at the other end to the mast of the elevator means. In this embodiment, the elevator means is pivotable about the connection of the leveling member and the elevator masts to orient the fork lift in a predetermined orientation according to the aforementioned features of the invention.

DETAILED DESCRIPTION OF THE PREFERRED EMBODIMENT

Figures 1, 2, 3:
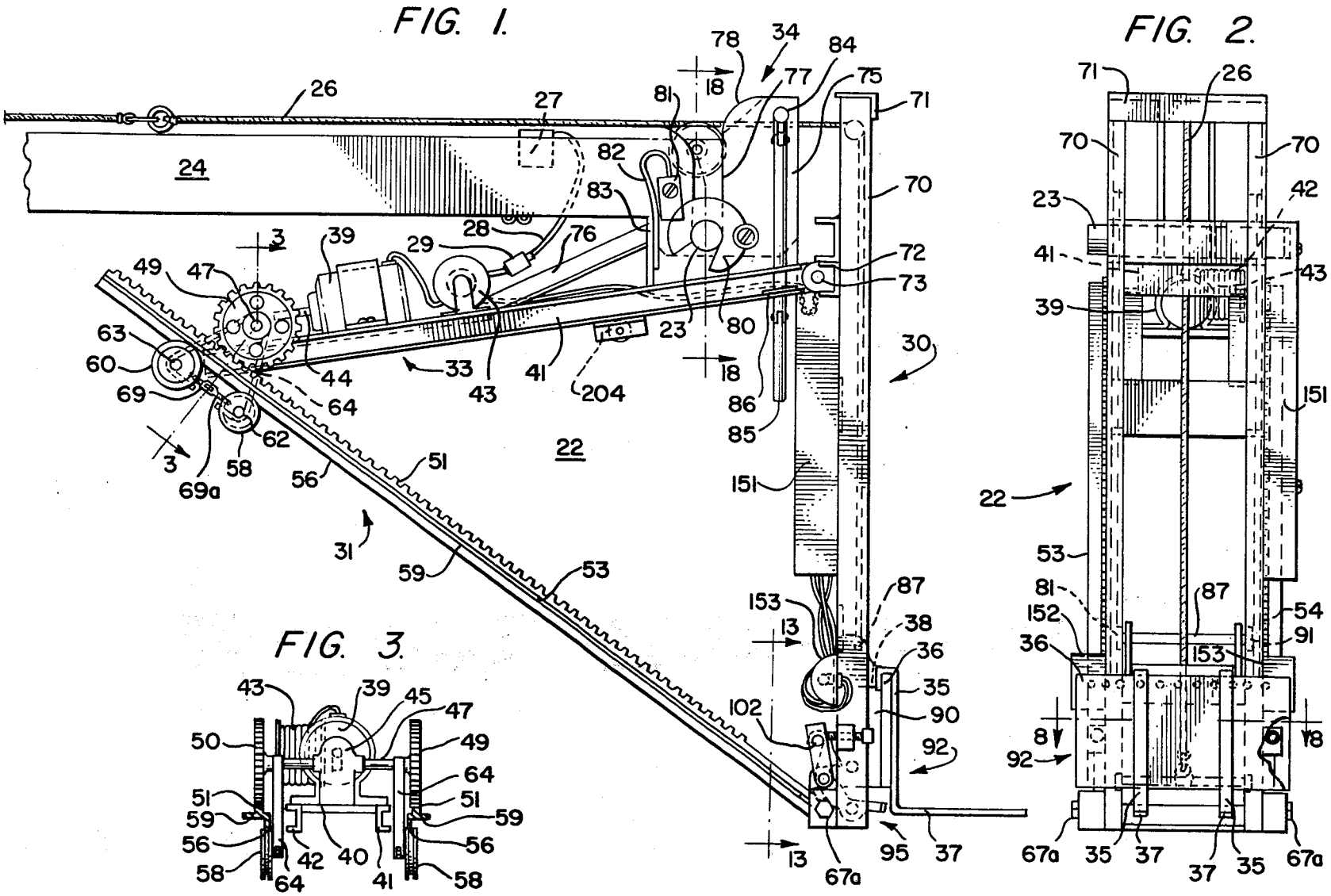
FIG. 1 is a right side elevational view of the fork lift attachment according to the invention secured to the distal end of the boom on a crane.
FIG. 2 is a front elevational view of the fork lift attachment in the same position as that shown in FIG. 1.
FIG. 3 is a cross sectional view taken along line 3—3 of FIG. 1 showing the worm drive mechanism and worm driven gears in engagement with the racks on the spaced leveling members of the leveling mechanism.

In FIG. 1, the fork lift attachment according to the invention, designated generally by the reference numeral 22, is secured to the outer ends of an attaching pin 23 located at or near the distal end of the boom 24 of the crane (not shown). The pin 23 is suitably secured, as by welding, to the boom 24. The attachment 22 is preferably used on the extreme end of the boom 24 on a hydraulic crane, but may be used with other types of cranes as well, or in positions located inwardly from the end of the boom, if desired, although that position is less desirable than the end of the boom. The boom 24 constitutes the end boom section of the crane and may comprise a portion of a telescoping boom assembly.

The fork lift attachment 22 is mechanically operated by the conventional load line 26 of the crane in a manner which will be discussed in greater detail. A junction box 27 provides an electrical lead 28 which may include a connecting plug 29 for completing the sole electrical connection of the attachment 22 to the crane. Thus, one of the advantages of the attachment 22 is that it may be used conveniently with existing cranes by simple inexpensive and convenient mechanical and electrical connections to the crane. On the other hand, if a hydraulically operated attachment is preferred, a single connection to the hydraulic system of the crane to power the attachment will suffice.

As shown in the drawings, the structural arrangement of the attachment 22 may be directly used without modification on an existing crane. In other cases, the attaching pins 23 may be secured to the boom of the crane for the purpose illustrated, or other equivalent securing means may be used.

The attachment 22 generally comprises an elevator assembly, designated generally by the reference numeral 30; leveling means, designated generally by the reference numeral 31 for maintaining the elevator assembly substantially vertically aligned throughout the range of operation of the boom 24, for example, from 0° to about 70° relative to the horizontal; a source of power, designated generally by the reference numeral 33 for operating the leveling means; and securing means, designated generally by the reference numeral 34 for non-pivotably securing the fork lift attachment 22 to the boom 24, while permitting the elevator assembly to pivot for adjustment purposes.

The elevator assembly 30 includes a plurality of fork members 35 laterally adjustably secured to a plate member 36 as will be hereinafter explained in greater detail. The fork members 35 may be raised and lowered to lift and lower a wide variety of loads, for example, palletized loads having a relatively substantial height as shown in phantom outline 32 in FIG. 4. It is another feature of the invention that the space above the tines 37 of the fork members 35 is substantially free from interference to accommodate high loads. The fork members are secured to the plate members 36 by a spring-loaded latch member 38.

While fork members are generally referred to in this description, the elevator assembly may utilize platform lifts or other types of specialty lifts in place of the fork members.

When a load, such as the load 32, is disposed on the tines 37 of the fork member 35 when the boom 24 is in its first position, for example, substantially horizontal, and the boom 24 is raised, it is desirable to maintain the load in a substantially level position. Otherwise, there are substantial risks that the load will topple from the fork member 35 during transfer of the position of the boom 24. Accordingly, the leveling means 31 are operated, either manually, or automatically as will be explained in greater detail, to maintain the desired orientation of the load. By way of example, it may be desirable to orient the load slightly forward of the vertical axis for safety reasons and to maintain that orientation during movement of the boom.

For electrically operated attachment, a motor 39 is electrically connected to the plug 29 and is located on a plate 40 disposed between a pair of fixedly spaced channel members 41 and 42. Preferably, a retractable spool 43 is provided to accommodate the electrical lead for reasons to be discussed in detail. The rotating shaft 44 of the motor 39 is connected to a worm drive assembly 45 mounted on the plate 40 for driving a pinion drive shaft 47. A pair of drive pinions 49 and 50 are secured to the outer edges of the shaft 47 to coact with a complementary rack 51 in the leveling means. For a conventional motor, it has been found convenient to gear down the motor speed to the drive pinions on the order of 136:1 or 125:1 to level loads of relatively high weight.

The leveling means 31 comprises a pair of spaced leveling members 53 and 54, the upper portion of each of which define a rack 51 for engaging the drive pinions 49 and 50. It is a feature of the invention that the leveling means 31 comprises a portion of the attachment 22 and is independent of the crane boom 24.

The side of each of the spaced members 53 and 54 opposite to the rack 51 defines an edge 56 for respectively receiving each of a pair of forward tracking rollers 58. The rollers 58 define a generally U-shaped recess about the circumference thereof to track along the edge 56. Each of the spaced members 53 and 54 also define a surface 59 for receiving the outer circumferential edge of a rearward tracking roller 60. The tracking rollers 58 and 60 have their shafts 62 and 63 respectively rotatably secured within members 61 and 61*a* at the opposed lower edges of the generally A-shaped turnbuckle designated generally by the reference numeral 64. The peak of the A-shaped turnbuckle assembly 64 comprises a member 65 which is rotatably secured to the pinion drive shaft 47, as best seen in FIGS. 1, 3, 6 and 7.

Figures 4, 5, 6, 7:
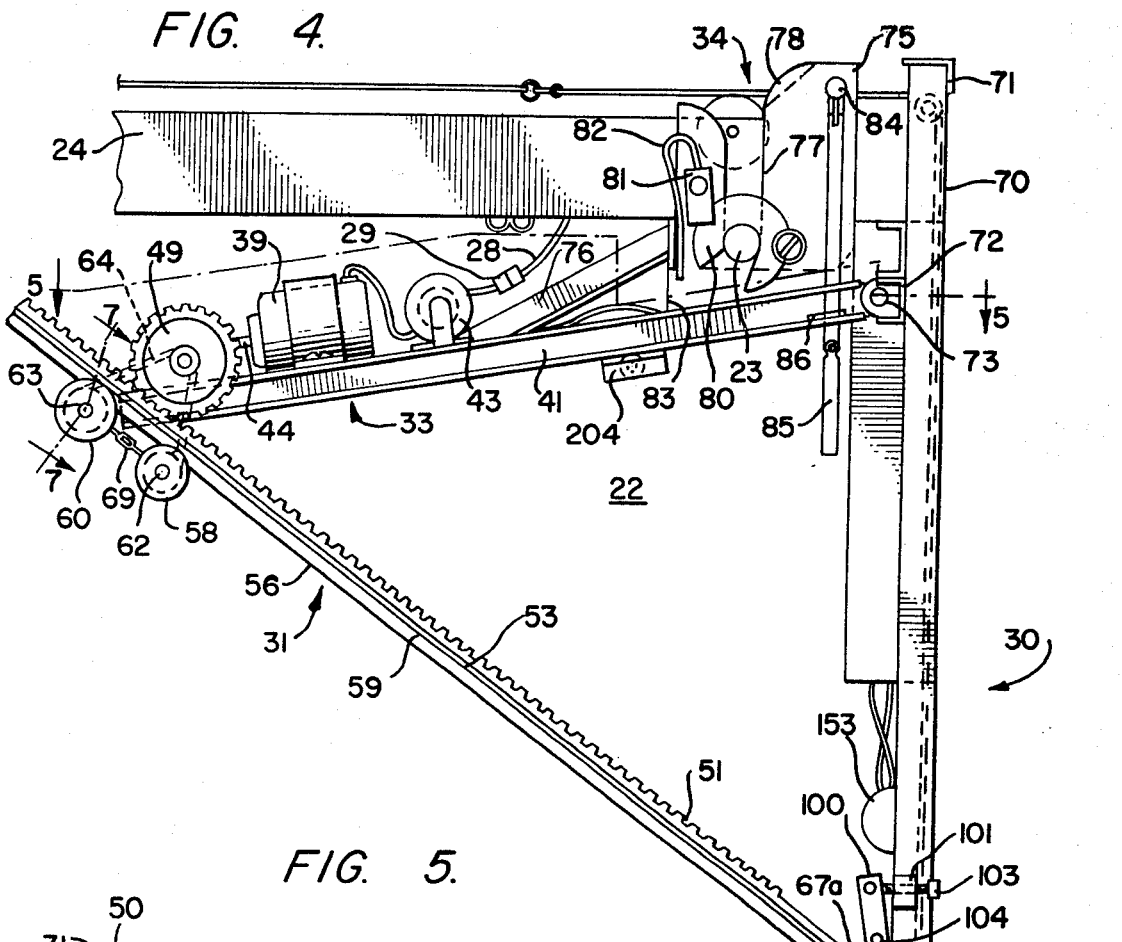
FIG. 4 is a right side elevational view similar to FIG. 1 illustrating the fork lift attachment and the inner telescoping frame members in their lowered position and wherein the fork lift attachment is substantially vertically oriented.
FIG. 5 is a view taken along line 5—5 of FIG. 4 showing the drive assembly for the leveling means.
FIG. 6 is a perspective view of the turnbuckle assembly which includes an upper end rotatably secured to the pinion drive shaft and the lower end adapted to receive the tracking wheels for adjustably engaging the lower ends of the leveling members which respectively define the gear rack.
FIG. 7 is a partial cross sectional view taken along line 7—7 of FIG. 4 which illustrates the tracking wheels engaging the lower end of the member which defines the gear rack.

As best seen in FIG. 6, the turnbuckle assembly comprises a pair of angled members 66 hinged to a central member 67 which is attached to the upper member 65 for accommodating the drive pinion axis. The inwardly turned portions of the angled members 66 are relatively adjustable to maintain the drive pinions 49 and 50 in engagement with their associated rack 51 and to maintain the pairs of tracking rollers 58 and 60 in their proper tracking relationship. A pair of internally threaded members 68 are respectively located on the upper surface of the inwardly-turned portions of the angled members 66 and are oppositely threaded. Thus, by turning the member 69, the threaded member 69*a* causes the angled members to advance or retreat, as desired.

In addition to its adjustment function, each turnbuckle assemble also acts as a suspension arm for suspending the leveling mechanism 31 from the pinion drive shaft 47.

The actuation of the motor 39 in such a manner to cause the drive pinions 49 and 50 to rotate in a clockwise fashion (as viewed in FIG. 1) will cause the spaced leveling members 53 and 54 to move upwardly and to the left in FIG. 1. Since the members 53 and 54 are secured at their lower ends by pins 67*a* to the lower edge of the main frame of the elevator assembly 30, the elevator assembly will move toward the left in FIG. 1 beyond the vertical axis. On the contrary, counter clockwise rotation of the drive pinions 49 and 50 will cause the spaced leveling members 53 and 54 to advance to cause the elevator assembly 30 to advance forwardly of the vertical axis. It can be understood that by advancing or retracing the leveling members 53 and 54 in cooperation with the movement of the boom 24, the elevator assembly 30 may be maintained in a substantially vertical position or in any other orientation which is desired by operation of the leveling means.

As is best seen in FIG. 5, the lateral spacing between the spaced members 41 and 42 is preferably of a lesser extent than the lateral spacing between the spaced leveling members 53 and 54 of the leveling means 31 so that for the length of the members 41 and 42 as shown, no interference between the respective pairs of spaced members exists for various positions of the drive pinions 49 and 50 relative to the rack 51. Other suitable arrangements are also possible. Moreover, the leveling members 53 and 54 are free from intermediate support members to avoid interference with the members 41 and 42, while pivotable about the pins 67.

The elevator means 30 include a pair of spaced, generally inwardly facing U-shaped main frame channels 70 secured at their upper end by a cross member 71. A channel member 72 secured to the main frame channels 70 is adapted to receive a pin 73 for securing the ends of the members 41 and 42 to permit the pivoting of the elevator assembly 30 about the pin 73. It may be understood that, as the drive pinions 49 and 50 track on the racks 51 of the leveling members 53 and 54, the channels 41 and 42 remain fixed relative to the boom head because of the securing means 34 so that the elevator assembly 30 will pivot about pin 73 during leveling.

The securing means 34 for securing the attachment 22 to the ends of the attaching pin 23 of the boom 24 comprises a pair of end plates 75 respectively secured at or near the ends of members 41 and 42 and supported at that position by a support member 76. The end plate 75 defines a generally U-shaped recess 77 smoothly contoured at the upper portion thereof as indicated generally by the reference numeral 78 so that the ends of the attaching pin 73 are readily cammed into the base of the U-shaped recess 77.

A pair of rotatable locking members 80 are secured to the end plate 75 and pivot about the ends of the attaching pin 73 when the attachment 22 is in position. The locking members are secured in a locked position by locking dogs 81 which are spring biased as by leaf springs 82 tensioned by members 83 at the outer surface of the end plates. The coaction of a locking member 80 with the ends of the attaching pin 73 and with a locking dog 81 will be described in greater detail in connection with FIGS. 19 and 20.

The end plates 75 are adapted to receive respectively a pair of secondary safety locking pins 84 linearly actuatable, as will be explained in greater detail, by a pair of secondary rod and linking arrangements 85 which, when locked, are capable of respectively receiving a pair of cotter pins 86 intermediate the flanges of the outwardly facing channel members 41 and 42. This apparatus will also be described in greater detail in connection with FIGS. 19 and 20.

The elevator means 30 includes a second pair of generally inwardly facing, U-shaped spaced channels 89 which are capable of telescoping within the main frame channels 70 during the ascent and descent of the fork member 35. The fork lift plate 36 includes a pair of inner webbed sections 90 which are secured, such as by pins 87 and 88 between the telescoping members 89.

A first pair of guide rollers 91 are rotatably secured to the outer ends of the pin 87, while a second pair of guide rollers 91*a* are rotatably secured to the ends of the pin 88. The guide rollers 91 and 91*a* are capable of tracking upwardly and downwardly within the U-shaped recesses of the inner telescoping channels 89 as the fork lift assembly is raised or lowered.

The hook of the load line of the crane is preferably secured to a fastening member 94 secured about the pin 88. Thus, the action of the load line causes the plate 36, the fork members 35, the webbed members 90, the pins 87 and 88, the guide rollers 91 and 91*a* and the fastening member 94 to operate as a unitary carriage assembly, designated generally by the reference numeral 92. Preferably, the load line is secured at or near the lower portion of the carriage assembly 92, such as at the pin 88 to gain the maximum height advantage through the use of the attachment relative to the head of the boom. It is thus an aspect of the invention that loads may be hoisted to a height greater than the height of the tip of the boom when the attachment 22 is positioned.

FIG. 7 is a partial view taken along line 7—7 of FIG. 4 showing the cross-sectional detail of the leveling member 53 which defines the surface 56 for receiving the U-shaped circumferential recess of the forward tracking roller 58 and the surface 59 for receiving the planar circumferential surface of the rearward tracking roller 60. The roller 60 is rotatably secured by the pin 63 in the member 61*a* in the turnbuckle assembly 64 and a portion of the angled member 66 of the turnbuckle assembly is shown. It can also be seen in FIG. 7 that the upper surface of the leveling member 53 defines the rack 51 which engages, in this case, the drive pinion 49. The terminal ends 74 of the pin 63 are circumferentially enlarged to retain the alignment of the assembly shown in FIG. 7. The construction of the forward roller 58 about the pin 62 rotatably secured in the member 61 in the turnbuckle assembly is similar to that shown in FIG. 7.

Figure 10:
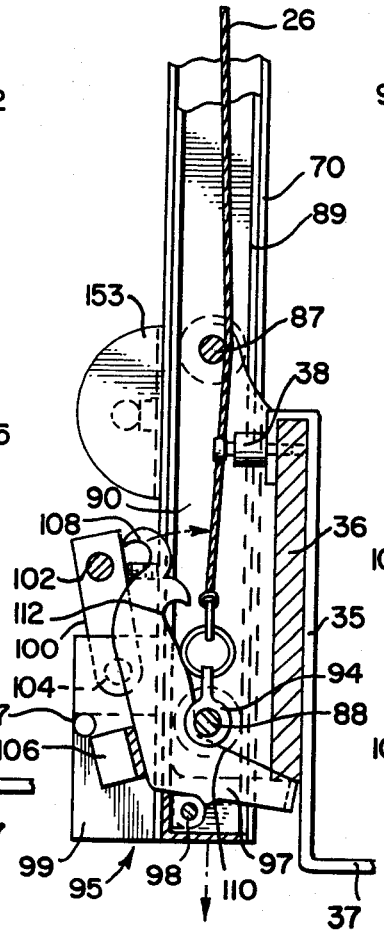
Figure 11:
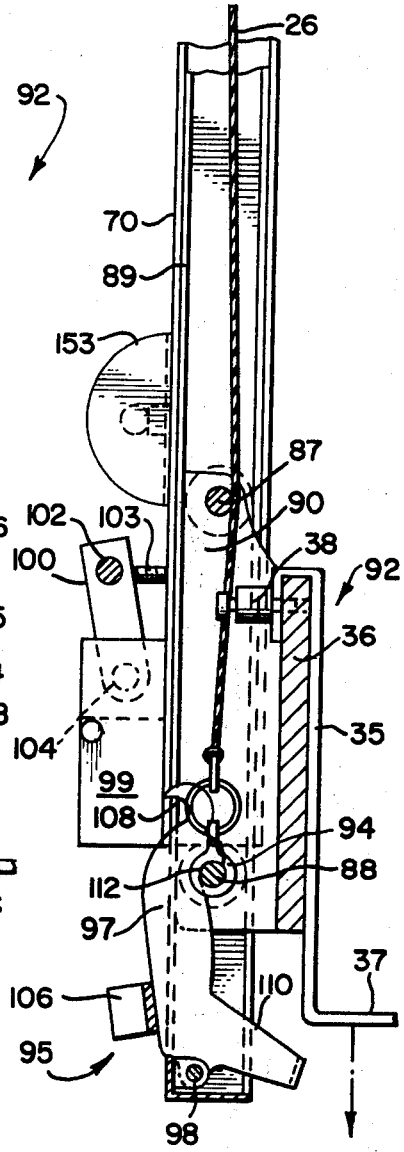
Figure 8:
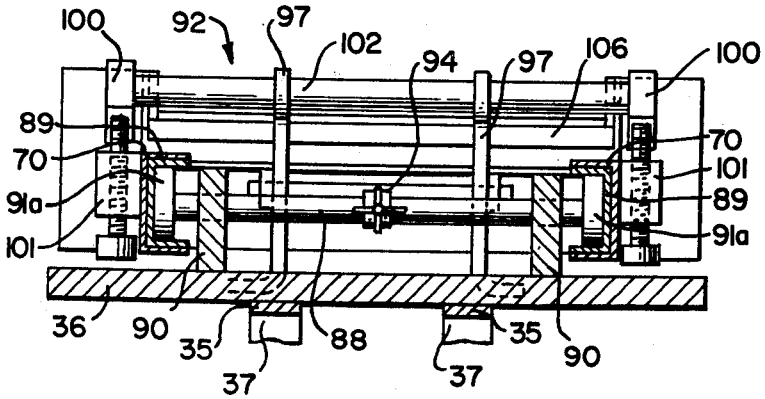
FIG. 8 is a cross sectional view taken along line 8—8 of FIG. 2 showing additional detail of the fork lift assembly.

FIG. 8 shows a cross sectional detail of the carriage assembly in greater detail wherein the pin 88 is journaled in a pair of guide rollers 91*a* which are capable of tracking within the channels defined by the telescoping members 89 as explained above. Thus, when the carriage assembly 92 is raised further from the position shown in FIG. 1, the inner telescoping members 89 are at their furthermost upward extent and further raising of the carriage assembly 92 will cause the fork members to travel upwardly supported within the members 89 by the rollers 91 and 91*a*. A latching arrangement, designated generally by the reference numeral 95 secures the inner telescoping members 89 in a latched position during further upward travel of the carriage assembly 92. Thus, FIGS. 9 through 11 illustrate the progressive unlatching and descent of the elevator mechanism as the carriage assembly 92 is progressively lowered.

Figure 9:
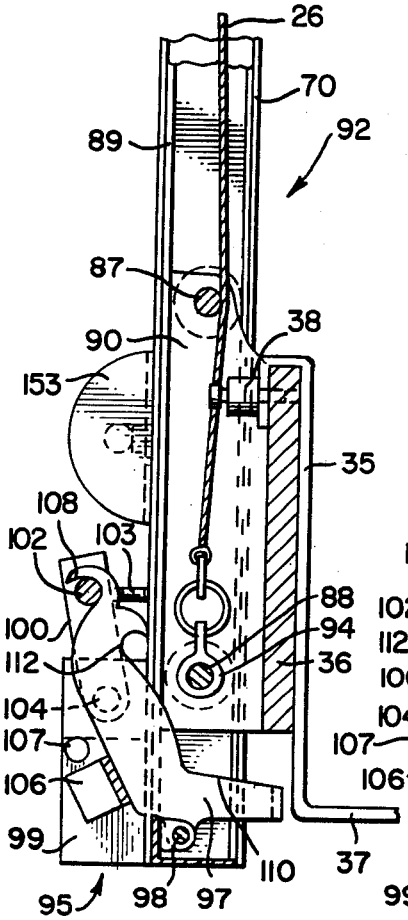
FIGS. 9–11 together show the progressive unlatching and descent of the fork and fork carriage assembly and illustrate the manner by which the locked inner telescopic member is caused to be released from the latch shaft by the latching hooks and secured to a trip shaft upon descent of the fork lift assembly below the extent of the main frame members.

FIG. 9 illustrates the condition wherein the inner telescoping members 89 are in their furthermost upward extent within the main frame members 70. A pair of latching members 97 are pivotably secured about a pin 98 secured between the pair of inner telescoping members 89. A pair of plates 99 are spacedly secured to the outer edges of the main frame channels 70 and are inwardly directed for receiving respectively a pair of adjustable latching members 100. A latching pin 102 is disposed between members 100.

A pair of adjusting members 101 are secured to the respective outer surfaces of the main frame members 70 and define threaded bores for respectively receiving the adjusting nuts 103. The adjusting nuts 103 adjustably locate the position of the latching pin 102 by pivoting the adjustable latching members 100 about the latching member retaining pins 104. A support member 106 is secured to an outer surface of each of the latching members 97 so that the members 97 operate in tandem.

When the carriage assembly 92 is positioned intermediate the length of the main frame 70, the latching member 97 is located as is shown in FIG. 9.

A crescent-shaped detent 108 in the upper left portion of the latching member 97 is secured on the latching pin 102. The arrangement secures the inner telescoping members 89 to the main frame members 70 because the latching pin 102 is secured by the members 99 and 100 to the main frame members 70 while the latching members 97 are secured to the inner telescoping members 89 about the pin 98. Thus, in effect, the inner telescoping members are suspended on the latching pin 102 while the carriage assembly 92 is in the position shown in FIG. 9.

As the carriage assembly is lowered, as best seen in FIG. 10, to about the lower end of the main frame members 70, the lower edge of the carriage assembly 92 strikes the laterally extending transfer portions 110 of the latching members 97. This contact causes the latching members 97 operating in tandem to pivot about the pin 98 and be released from the latching pin 102 in such a manner that a second crescent-shaped detent 112 (on the side of the latching member 97 opposite the detent 108 which engages the locking pin 102) is caused to be received upon the pin 88 on the carriage assembly 92. Upon further lowering of the carriage assembly 92 as seen in FIG. 11, the weight of the telescoping members 89 and the latching assembly 95 are suspended upon the pin 88 for further descent.

By the pivotal action of the latching members 97 about the pivot pin 98, the weight of the inner telescoping members 89 and the latching arrangement 95 are transferred from suspension on the latching pin 102 to the pin 88 on the carriage assembly. The latching members 97 remain in contact with the pin 88 for all descent of the carriage assembly 92 below the extent of the main frame members 70.

When the carriage assembly 92 is raised, the support member 106 contacts pin 107 to cause the latching member to pivot about the pivot pin 98. This action releases the detent 112 from contact with the pin 88 and causes the detent 108 to re-engage the latching pin 102.

The apparatus of the invention may include an electrically operated automatic load leveling capability. The automatic leveling electrical assembly is designated generally by the reference numeral 150 and is enclosed within a weathertight casing 151 disposed upon one side of the main frame 70 for operating a pair of indicating lamps 152 and 153 disposed on opposite sides of the main frame 70 on the elevator means. The electrical circuitry 150 includes a first microswitch 155 and a second microswitch 156 having mechanical arms 157 and 158 respectively attached to the microswitches. A pendulum member 160 is pivotally secured for free rotation about the pin 161. When the elevator assembly 30 is substantially vertically oriented, a pendulum bob 162 secured to the pendulum member 160 is free from contact with either of the arms 157 and 158 so that the microswitches are not actuated. In this situation, a green light, for example, may be indicated on the visual indicators 152 and 153 to represent that condition.

Figure 12:
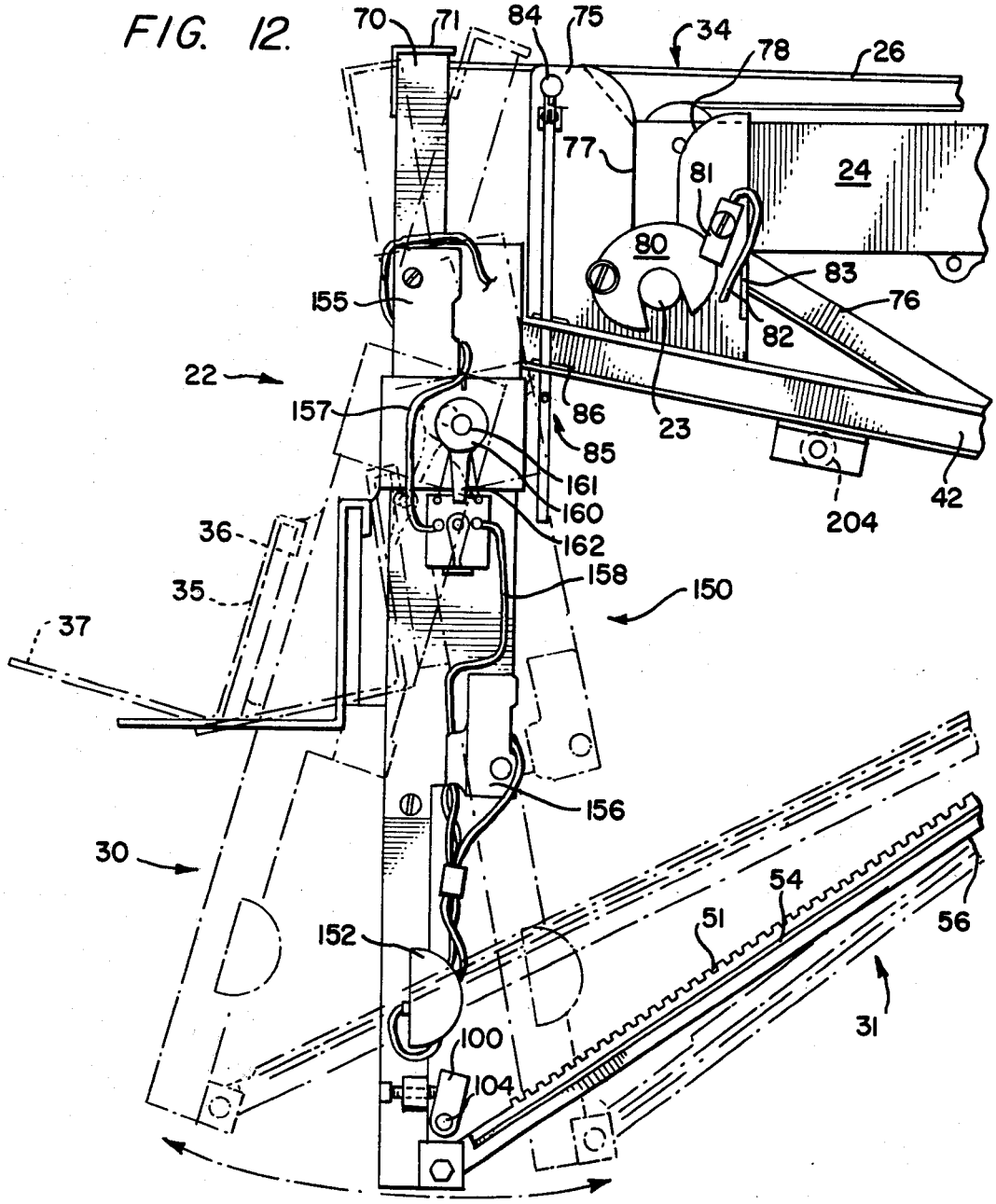
FIG. 12 is a left side elevational view of the fork lift apparatus according to the invention illustrating the automatic leveling feature and the signaling mechanism and further illustrating in phantom outline the forward and reverse leveling capabilities of the apparatus.

As the elevator assembly 30 tends to locate forwardly of the vertical axis during the raising of the boom, for example, the pendulum bob 162 moves to the right in FIG. 12 to cause the arm 158 to actuate the microswitch 156. This condition will cause a second light, for example, a yellow light, on the visual indicators 152 and 153 to be actuated to represent the situation that the load is beginning to locate forwardly of the vertical axis. Similarly, as the boom is lowered, for example, and the load tends to position rearwardly of the vertical axis, the pendulum bob 162 moves to its forward position in FIG. 12 from its neutral position to actuate the microswitch 155 to actuate a third visual indicator on the indicators 152 and 153. Preferably, this indication is to indicate the danger of the load tipping from the tines 37 of the fork member 35 and this condition causes a red light on the indicators 152 and 153 to flash or otherwise appear.

Figure 13:
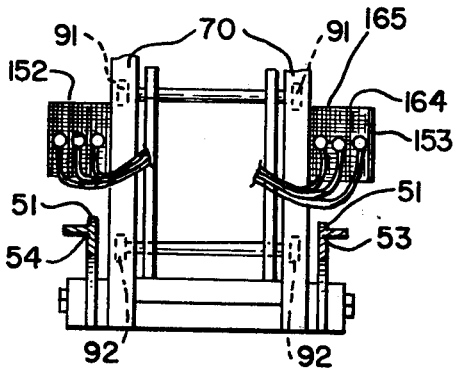
FIG. 13 is a cross sectional view taken along line 13—13 of FIG. 1 showing the detail of the indicator lights on the elevator main frame members.

As may be seen in FIG. 13, the indicator lights are preferably located on opposite sides of the main frames 70 so that the crane operator may view the indicators, or either of them, from his seat in the cab of the crane.

Structurally, the indicators are generally semi-circularly shaped in cross section and comprise a pair of generally semicircular spacing members 164 and 165 therewithin to divide the housing into three compartments for housing the various colored visual indicators described above. The semi-circularly shaped visual indicator is particularly advantageous in such a situation to permit the operator to view the indicators at any degree of the boom angle from 0° to about 70° relative to the horizontal.

Figure 14:
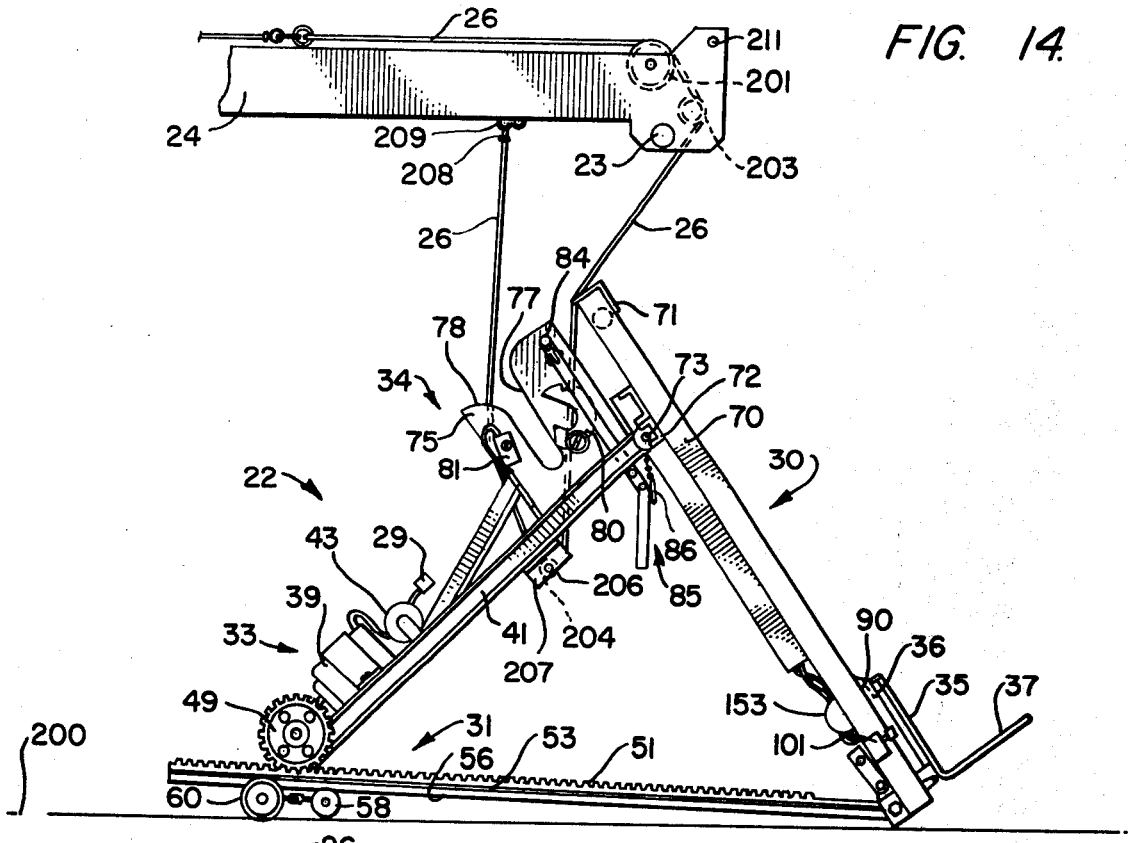
FIGS. 14–16 illustrate a sequence of steps for raising the apparatus of the invention from a ground level to secure the apparatus to the attaching pins on the boom of the crane by the use of the load line of the crane.

FIGS. 14 through 17 illustrate a sequence of steps for raising the apparatus 22 of the invention from the ground, or other convenient surface, designated by the reference numeral 200 to be secured and latched to the boom 24. In FIG. 14, the boom 24 of the crane has been spotted or located relative to the attachment 22. The load line 26 of the crane is reeved over a guide spool 201 rotatably secured in the boom 24 and over a boom head guide spool 203 which is also rotatably secured in the boom head. The load line is threaded between the members 41 and 42 about a connect/disconnect guide spool 204 rotatably secured between the members 41 and 42 on the apparatus 22 of the invention. The guide spool 204 is journaled about an axle 206 secured between a pair of plates 207 respectively connected to the lower surfaces of the guide members 41 and 42.

Thereafter, the load line 24 is secured by its hook 208 to an eyelet 209 secured to the boom 24 of the crane. The eyelet 209 may form part of a bracket secured, for example, by welding on the bottom of the boom 24 and which is sized to accommodate the hook 208 to pivot freely within the eyelet 209. When thus secured, the apparatus is capable of being raised from the ground by the retraction of the load line 24 of the crane.

Figure 15:
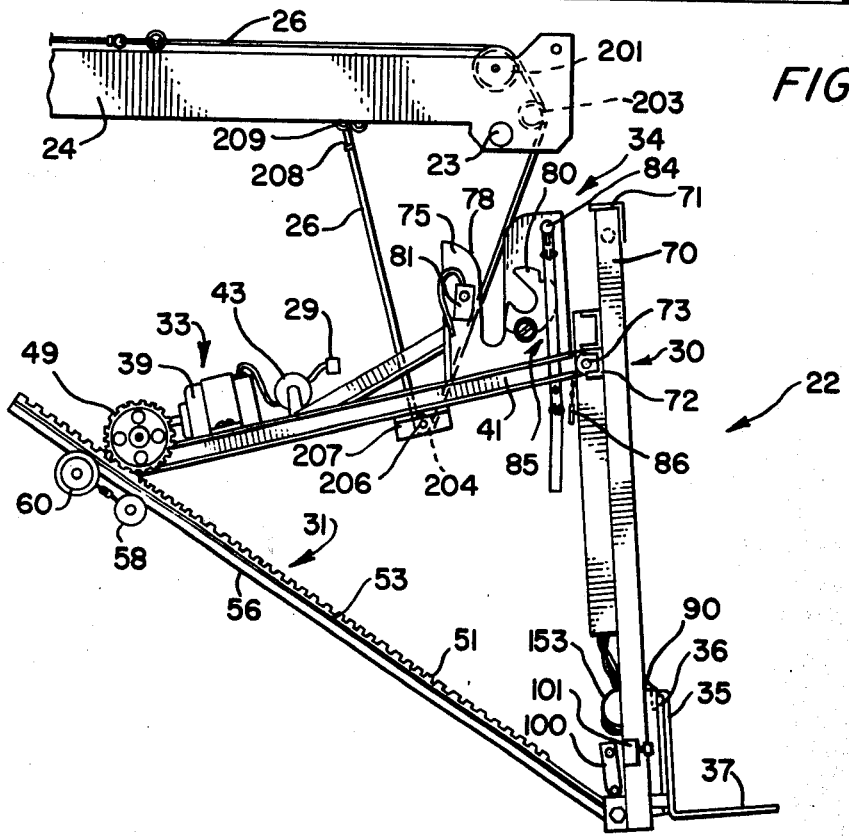
Figure 16:
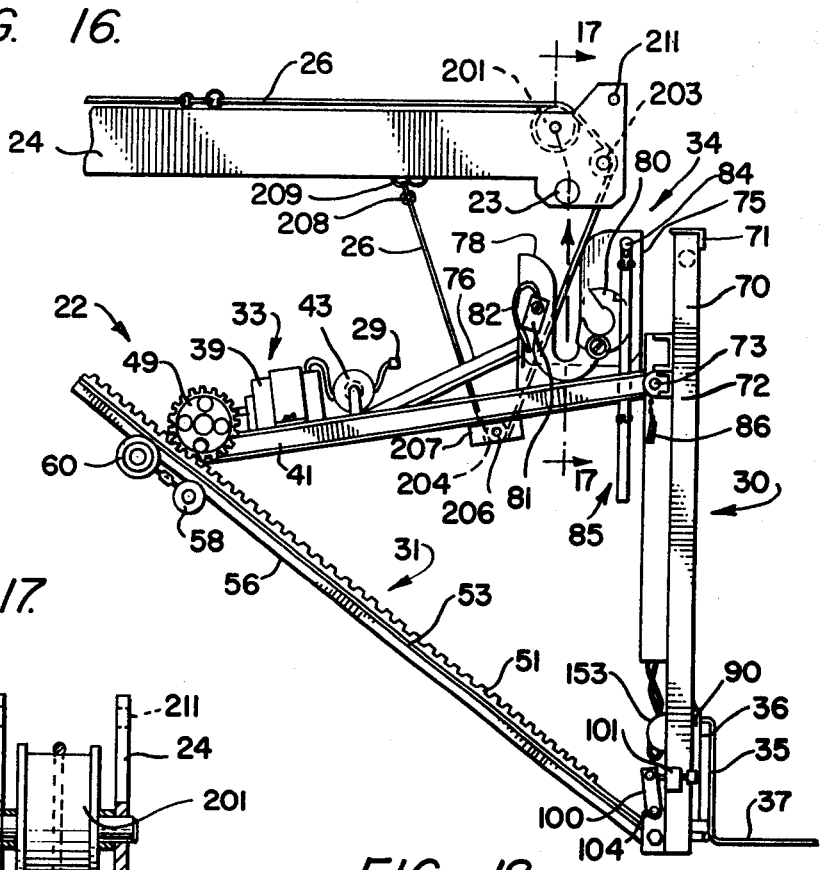

As shown in FIG. 15, the retraction of the load line 24 of the crane has caused the apparatus 22 to be lifted from the ground 200 by pivoting about the lower end of the elevator mechanism 30 and causing the distal ends of the leveling members 53 and 54 to be raised. As the apparatus 22 is raised, the U-shaped recesses 77 on the end plates 75 are brought into substantially vertical alignment with the attaching pin 23 on the boom 24.

Figure 17:
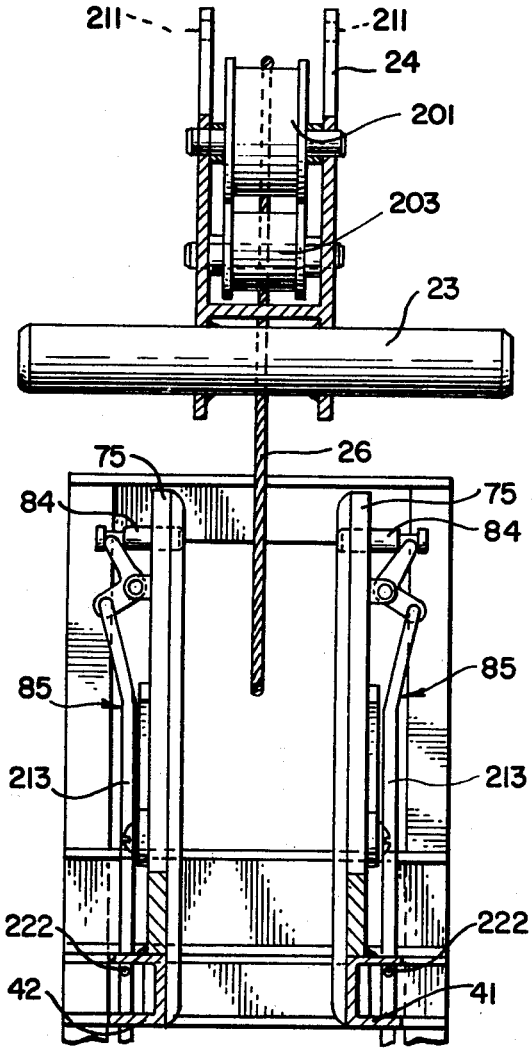
FIG. 17 is a cross sectional view taken along line 17—17 of FIG. 16 showing the apparatus of the invention relative to the boom of the crane prior to latching.
Figure 18:
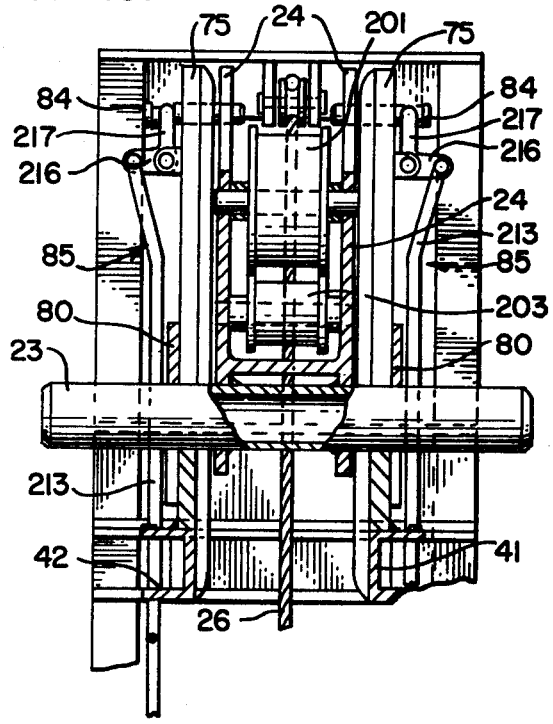
FIG. 18 is a cross sectional view taken along the line 18—18 of FIG. 1 showing the apparatus of the invention latched to the boom of the crane.

The position of the connect/disconnect spool 204 is selected to cause the substantially vertical alignment of the U-shaped recess with the attaching pin as is shown in FIG. 17 when the apparatus 22 has been raised. The precise position of the spool 204 is determined by the position of the forward guide spool 203 on the boom 24 and the position of the eyelet 209 as well as by the relative weighting of the components of the apparatus 22. In FIGS. 14–17, it will be noted that the locking member 80 is in its open position for securing the attachment 22 to the boom head 24.

The positioning of the connect/disconnect spool 204 is also selected to permit the apparatus 22 to be raised from the ground during the attaching process and thus attached at a point substantially above the ground surface 200, because its position permits the apparatus to balance in mid-air with the desired alignment described above.

Figure 19:
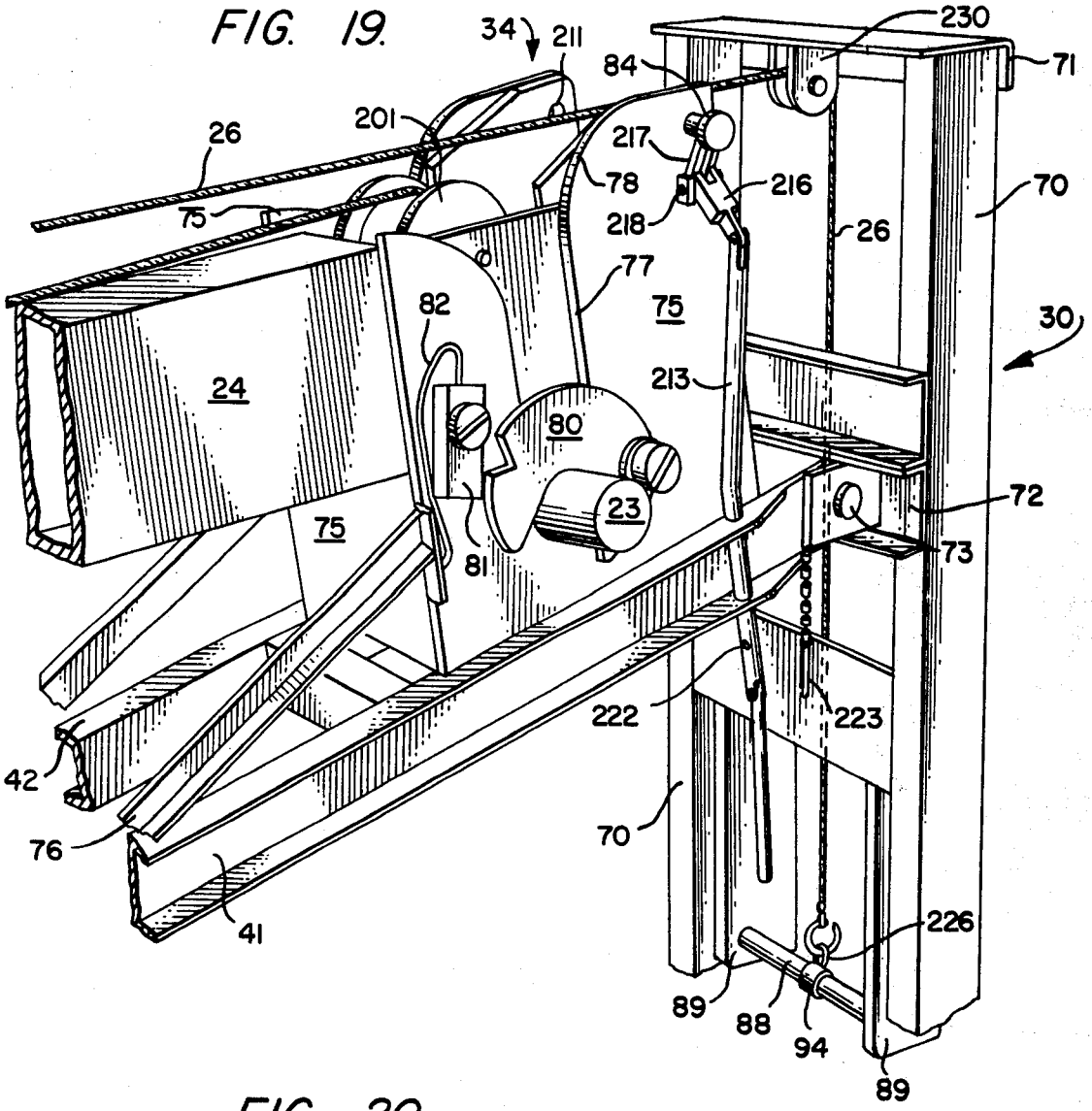
FIG. 19 is a partial perspective view of the apparatus of the invention engaged with the attaching pin on the end of the boom prior to the engagement of the secondary locking pins with the end of the boom.

Continued raising of the apparatus 22 by the load line 24 causes the U-shaped recess 77 to envelop the attaching pins 23 and to cause the locking members 80 to pivot about the attaching pins at the lowestmost portion of the recess, as best seen in FIG. 19. The camming surfaces 77 and 78 assist the guidance of the apparatus 22 onto the pin 23 during the attaching process.

The view in FIGS. 17 and 19 illustrates the position of the secondary locking pin 84 aligned with the openings 211 in the end plates 75. The push rod linkage, generally designated by the reference numeral 85 in FIG. 1, comprises a first member 213 passing through a pair of aligned recesses 214 in the channel 41 and terminating in its upper end in a bifurcated section for receiving a flange on a second member 216. The second member is connected to a third member 217 pivoted about an axle 218. Thus, when the member 213 is raised upwardly, the secondary locking pin 84 is inserted in the opening 211 and effectively spring-biased therein.

Figure 20:
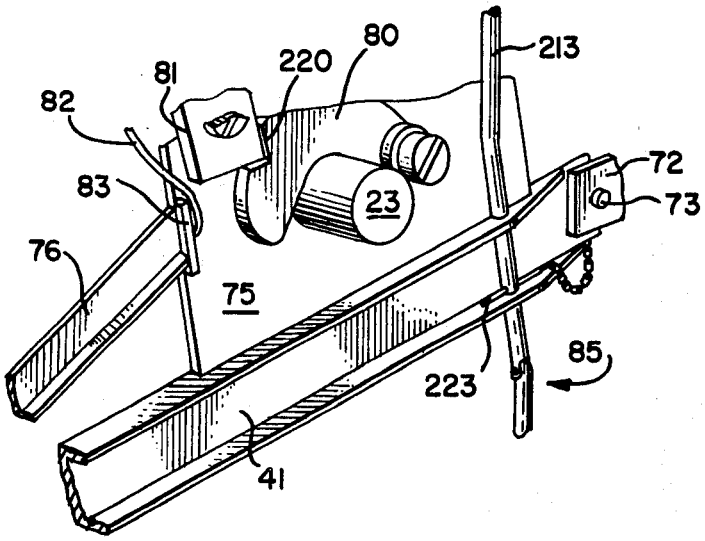
FIG. 20 is a partial perspective view of a portion of FIG. 19 after the secondary locking pins have been engaged and a cotter pin has secured the secondary locking pin push rod mechanism.

In FIG. 20, the locking dog 81 has engaged with a locking surface 220 to secure the locking member 80. Additionally, the secondary push rod mechanism 85 has been uplifted so that the recesses 222 in the first member 213 thereof are located between the webs of the channel 41 for receiving the cotter pin 223. Thus, in its fully latched position, the primary latching mechanism comprising the locking member 80 and the locking dog 81 is located in the slot 220 to secure the locking member 80 in position. As a secondary safety feature, the secondary locking pins 84 have been recessed in the openings 211 and the member 213 is secured by cotter pin 223 to maintain the pins 84 in place.

After the apparatus 22 has been secured to the boom as described in connection with FIGS. 14 through 17, 19 and 20, the operator will release the tension on the load line so that the hooks 208 may be removed from the eyelet 209. Thereupon, the slack in the load line will be taken up to secure at the eyelet 226 with a permanent cable for the fork lift assembly. If desired, a fixed line cable may be maintained on the elevator assembly, for ease of connection to the hook on the load line 24, or the load line may be directly connected to the pin 88.

In order to accommodate substantial reaches of the boom 24, it may be desirable for the electrical connection to the crane to be disposed about a retractable spool 43 which may be located either on the device itself as shown in FIG. 1 or on the boom of the crane. When located as shown in FIG. 1, the cable may be taken in or played out for all ranges of throw of the boom 24. The use of a retractable spool is particularly advantageous, for example, when the boom is oriented at about 70 degrees with respect to the horizontal and the drive pinions 49 and 50 have tracked down the racks 51 to the point nearest the fork lift assembly to maintain the fork members 35 in a substantially level position. In this extreme position, or in the opposite extreme position, the use of such spool is advantageous to accommodate the electrical connection to the crane.

Preferably the load line 26 on the crane is reeved about a guide member 230 in the elevator means 230 secured to the cross member 71 so that the load line is substantially vertically oriented above the fastening member 94 for efficient raising and lowering of the carriage assembly.

The source of power for the leveling means may be radio-controlled or otherwise remotely controlled from the ground level or from any other convenient location. In this way, the leveling of the load is accomplished by signals from the remote operator. Moreover, the source of power may be self-contained, as well, for example, comprising a self-contained steam unit or battery powered drive unit to operate the attachment as previously described.

Figure 21:
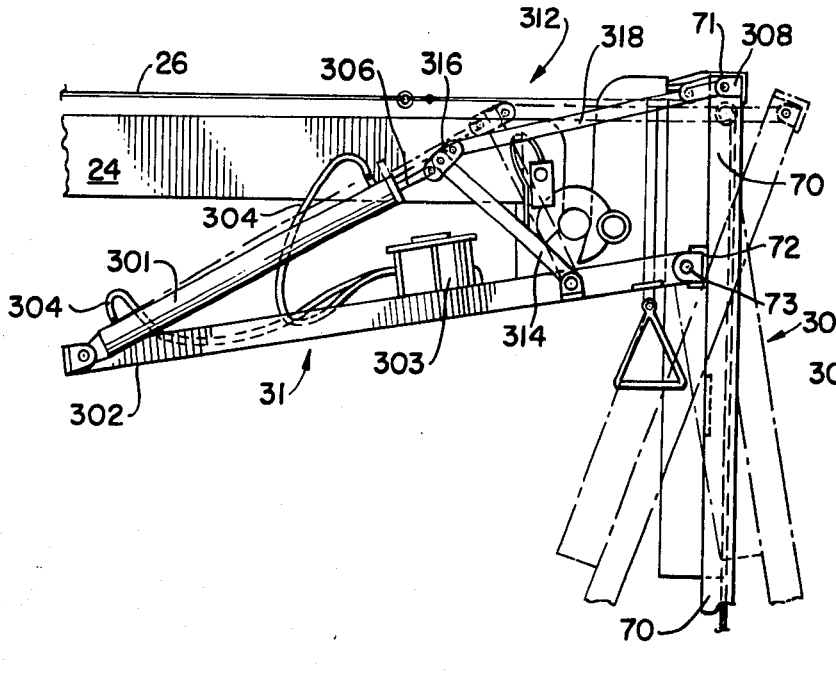
FIG. 21 is a partial side elevational view similar to FIG. 1 illustrating another embodiment wherein the leveling means includes a pair of hydraulically-actuated cylinders and linking means for orienting the elevator assembly.
Figure 22:
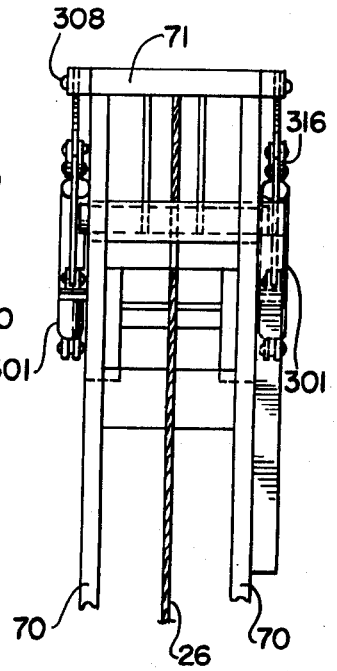
FIG. 22 is a partial front elevational view of the embodiment of FIG. 21.
Figure 23:
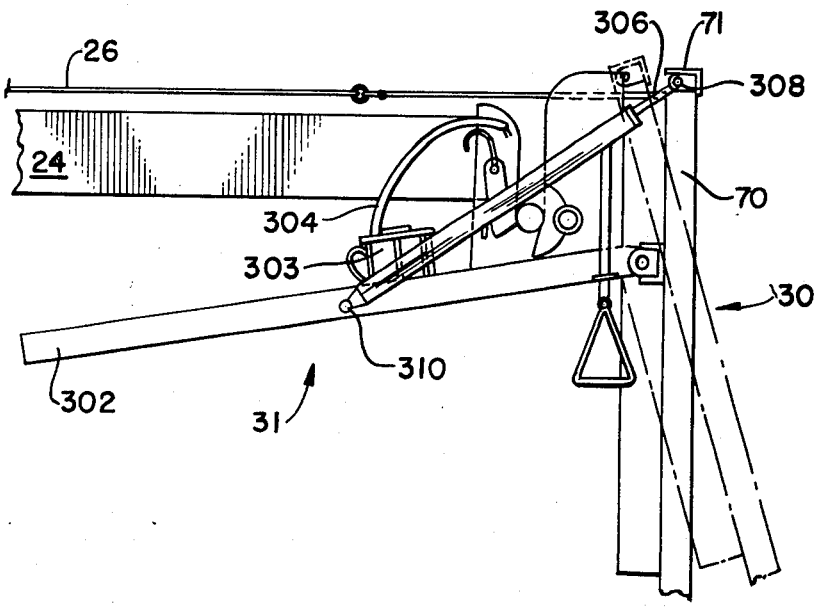
FIG. 23 is a partial side elevational view similar to FIG. 21 wherein the hydraulically-actuated cylinders are directly connected to the leveling members and to the elevator assembly.

The embodiment shown in FIGS. 21–23 is similar to the embodiments previously shown and described and differs therefrom in that the leveling means 31 include a pair of hydraulically-actuated members 301 secured at one of the ends thereof to the leveling members 302. The members 301, preferably hydraulic cylinders, are connected to a hydraulic power unit 303 through conduits 304 for hydraulic fluid connected respectively to the upper and lower ends of the members 301.

The leveling members 302 are similar to the leveling members previously described, but need not include the teeth and guide configurations earlier described. Rather, the members 302 may be channel members.

As shown in FIG. 23, the extensible piston members 306 of the cylinders 301 are connected directly to the mast members 70 by suitable pins 308. The other ends of the cylinders 301 are connected, by way of example, to pins 310 located at points intermediate the ends of the leveling members 302. The precise location of the pins 310 along the length of the leveling members 302 is primarily a matter of choice governed by the engineering needs of the particular embodiment. In operation, actuation of the cylinder 301 by the flow of hydraulic fluid from the power means 303 causes the piston to pivot the mast members 70 about the pin 73 to orient the fork lift assembly as previously described. Representative orientations of the mast are shown in phantom outline.

The embodiment of FIGS. 21 and 22 operates similarly to the embodiment of FIG. 23 but further includes linking means designated generally by the reference numeral 312. The linking means 312 include for each cylinder 301, an idler member 314 pivotably connected at one end to the leveling member 302 and at the other end to a connecting link 316. The connecting link 316 is also connected to the extensible piston member 306 and to an end of the linking members 318 which is connected at its other end to the mast member 70 at pins 308. Thus, actuation of the cylinder 301 causes the members 314 and 318 to pivot to orient the mast members 70 and the fork lift assembly as previously described.

Either one or a plurality of such cylinders may be used in accordance with the teachings of the invention.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. In combination with a boom on a crane characterized as including a control line, the improvement comprising a materials handling apparatus which is mobile with said boom to provide a lift capability to the crane, said apparatus being free from supportive engagement with any support member of the crane other than the free end of the boom and comprising:

lift means, said lift means including a lift member operable by said control line for receiving loads on said lift member;

automatic leveling means for positively and mechanically selectively orienting said lift means independent of said boom to maintain said lift member and any loads thereon in about a predetermined orientation, said leveling means being operable while said boom is mobile and in response to the position of either said boom or a selected portion of said apparatus sensed by sensor means and further characterized in that said leveling means automatically maintains the orientation of said lift means and any loads thereon substantially throughout the range of throw of said boom;

power means for selectively actuating said leveling means, said power means being responsive to said sensor means; and securing means for securing said apparatus to the boom of the crane, said securing means serving to rigidly attach said apparatus to the free end of the boom and being the only means for supporting and securing the apparatus to the boom.

2. The improvement as set forth in claim 1 wherein said lift means is secured to substantially the end of said boom.

* * * * *